United States Patent [19]

Roberts

[11] 4,090,276

[45] May 23, 1978

[54] TEXTILE CARDING

[75] Inventor: Gordon Roberts, Marsaxlokk, Malta

[73] Assignee: Glen Walton Company Limited, England

[21] Appl. No.: 706,601

[22] Filed: Jul. 19, 1976

Related U.S. Application Data

[60] Continuation of Ser. No. 481,829, Jun. 21, 1974, abandoned, which is a division of Ser. No. 315,415, Dec. 15, 1972, abandoned.

[30] Foreign Application Priority Data

Dec. 28, 1971 United Kingdom ..... 60242/71

[51] Int. Cl.[2] ..... D01G 15/12; D01G 15/84

[52] U.S. Cl. ..... 19/99; 19/106 R; 19/112; 19/114

[58] Field of Search ..... 19/98, 99, 97, 105, 19/106 R, 112, 114

[56] References Cited

U.S. PATENT DOCUMENTS

| | | | |
|---|---|---|---|
| 896,437 | 8/1908 | Collins | 19/97 X |
| 906,993 | 12/1908 | Bates et al. | 19/114 X |
| 1,346,637 | 7/1920 | Coulston | 19/97 |
| 1,880,670 | 10/1932 | Bates | 19/99 |
| 2,939,183 | 6/1960 | Tempest et al. | 19/114 |
| 3,391,430 | 7/1968 | Bryan, Jr. | 19/106 R |
| 3,423,796 | 1/1969 | Norstrand | 19/97 |

FOREIGN PATENT DOCUMENTS

| | | | |
|---|---|---|---|
| 1,493,015 | 7/1967 | France | 19/114 |
| 16,912 | 7/1968 | Japan | 19/112 |

*Primary Examiner*—Dorsey Newton
*Attorney, Agent, or Firm*—Norris & Bateman

[57] ABSTRACT

A roller train in a carding machine comprises first, second and third card-clothed rollers, the second roller having two sets of teeth pointing in opposite directions, and the relative surface speeds of the rollers being such that one set of teeth on the second roller has point-to-point action with the teeth in the first roller and the other set of teeth on the second roller has point-to-point action with the teeth on the third roller.

7 Claims, 17 Drawing Figures

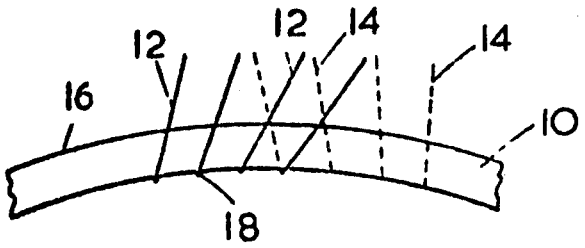
-FIG. 1-
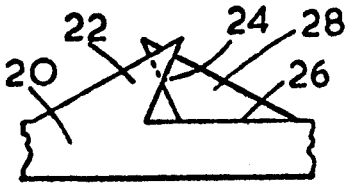
-FIG. 2-
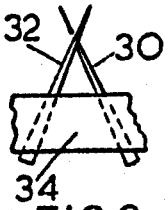
-FIG. 3-
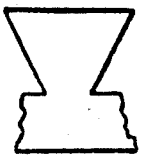
-FIG. 4-
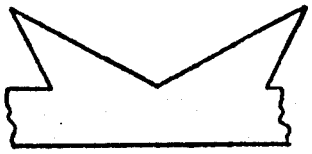
-FIG. 5-
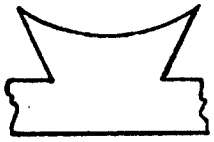
-FIG. 6-
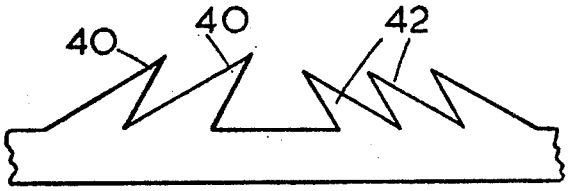
-FIG. 7-
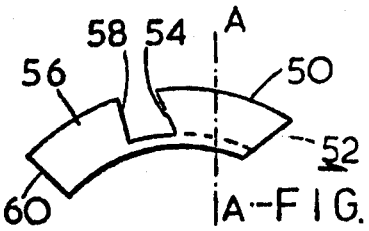
-FIG. 8-
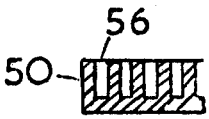
-FIG. 9-

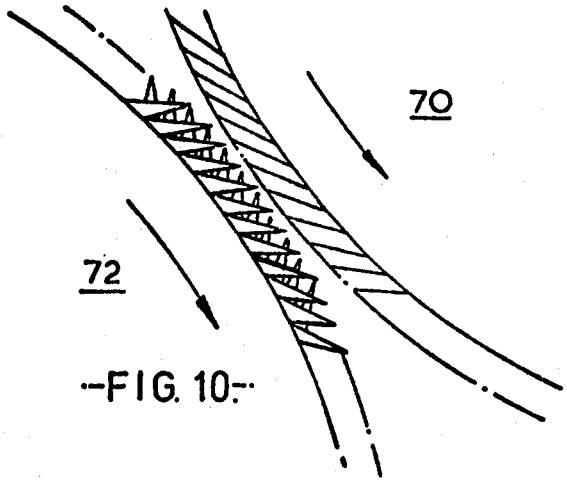
--FIG. 10--
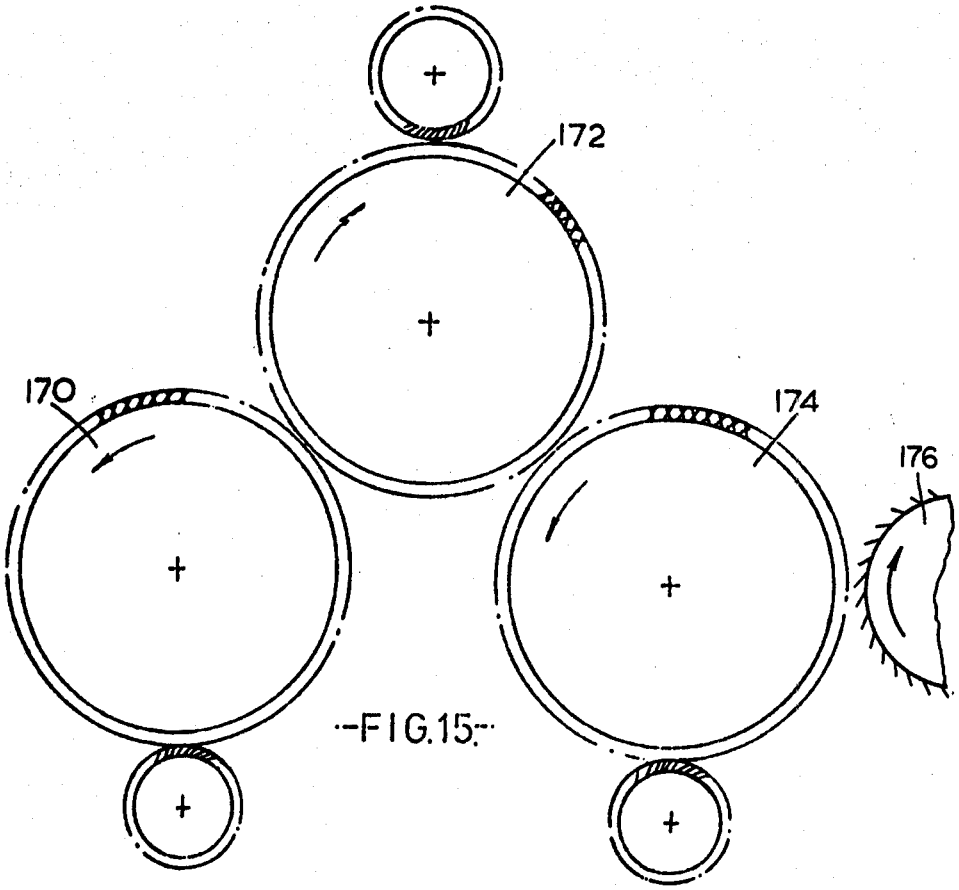
--FIG.15--

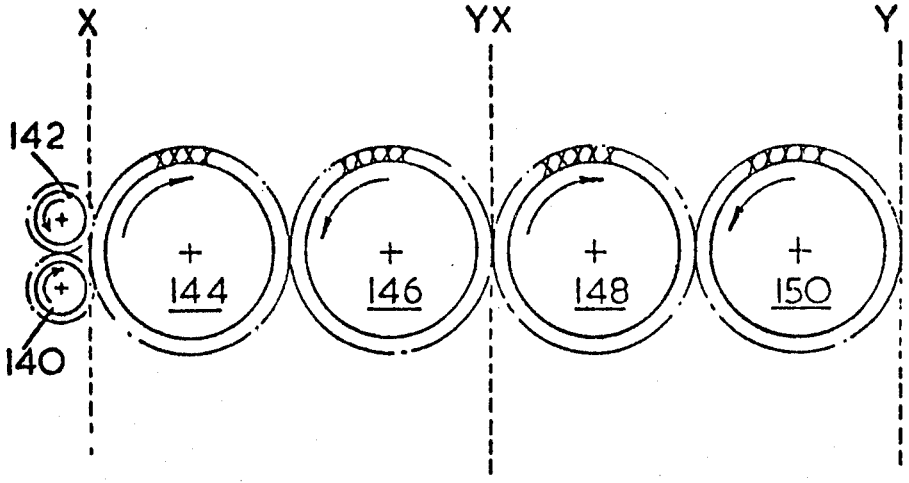
-FIG. 13-
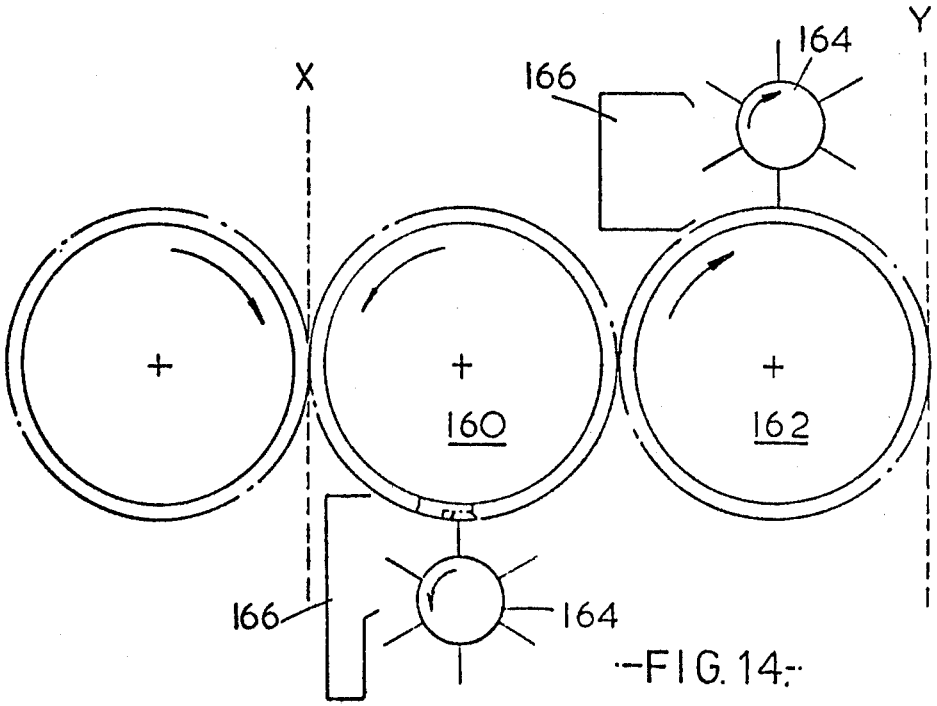
-FIG. 14-

TEXTILE CARDING

This is a continuation of application Ser. No. 481,829 filed June 21, 1974, now abandoned, which in turn was a division of application Ser. No. 315,415 filed Dec. 15, 1972, now abandoned.

In the specification and the claim, certain words and expressions have special meanings ascribed to them, as follows:

"Teeth" — means the part of the flexible wire card clothing which project from the foundation; or the parts of pin type card clothing which project from the foundation, or the parts of metallic wire type card clothing which project above the bottoms of the recesses cut into the wire to form the teeth.

"Surface of the foundation" — means in relation to wire or pin type card clothing the surface which is exposed when the card clothing is fitted and from which the teeth project, and its relation to metallic wire type card clothing, it means the plane which includes the bottoms of all the recesses between the teeth so that the teeth proper project about this surface.

"Intermingled" — means that the teeth of one set are arranged amongst the teeth of another set, and the teeth are not divided into groups each of one set following each other in the direction of motion of the card clothing in use, It is an object of the invention to provide a roller train for use in a carding machine, which train is capable of carrying out a particularly effective opening action on the fibres presented to it for carding. More especially, a roller train in accordance with the invention is adapted to open the fibres without a severe tearing action.

A further object of the invention is to provide a roller train for use in a carding machine comprising a first card clothed roller co-operating with a second card clothed roller, said second card clothed roller further co-operating with a third card clothed roller, said second card clothed roller having a first set of teeth pointing in the direction of rotation of said second card clothed roller and co-operating in point-to-point fashion with at least some of the teeth on said first card clothed roller and a second set of teeth pointing in opposition to the direction of rotation of said second card clothed roller, said second set of teeth co-operating in point-to-point fashion with at least some teeth on said third card clothed roller.

According to a preferred feature of the invention said second card clothed roller rotates in a direction opposite to that of said first card clothed roller and said third card clothed roller rotates in a direction opposite to that of said second card clothed roller; and said second card clothed roller rotates at a faster surface speed than said first card clothed roller, and said third card clothed roller rotates at a faster speed than said second card clothed roller.

It has also been found advantageous to arrange the rollers so that the surface speed of the first roller is not less than 30% of the surface speed of the second roller, and further so that the surface speed of the second roller is not less than 30% of the surface speed of the third roller.

Other features of the invention will appear from the following description of several forms of the invention which are given here by way of examples only. In the accompanying drawings:

FIG. 1 is a section through a flexible wire type of card clothing,

FIGS. 2 to 7 show different forms of card clothing,

Figure 11:
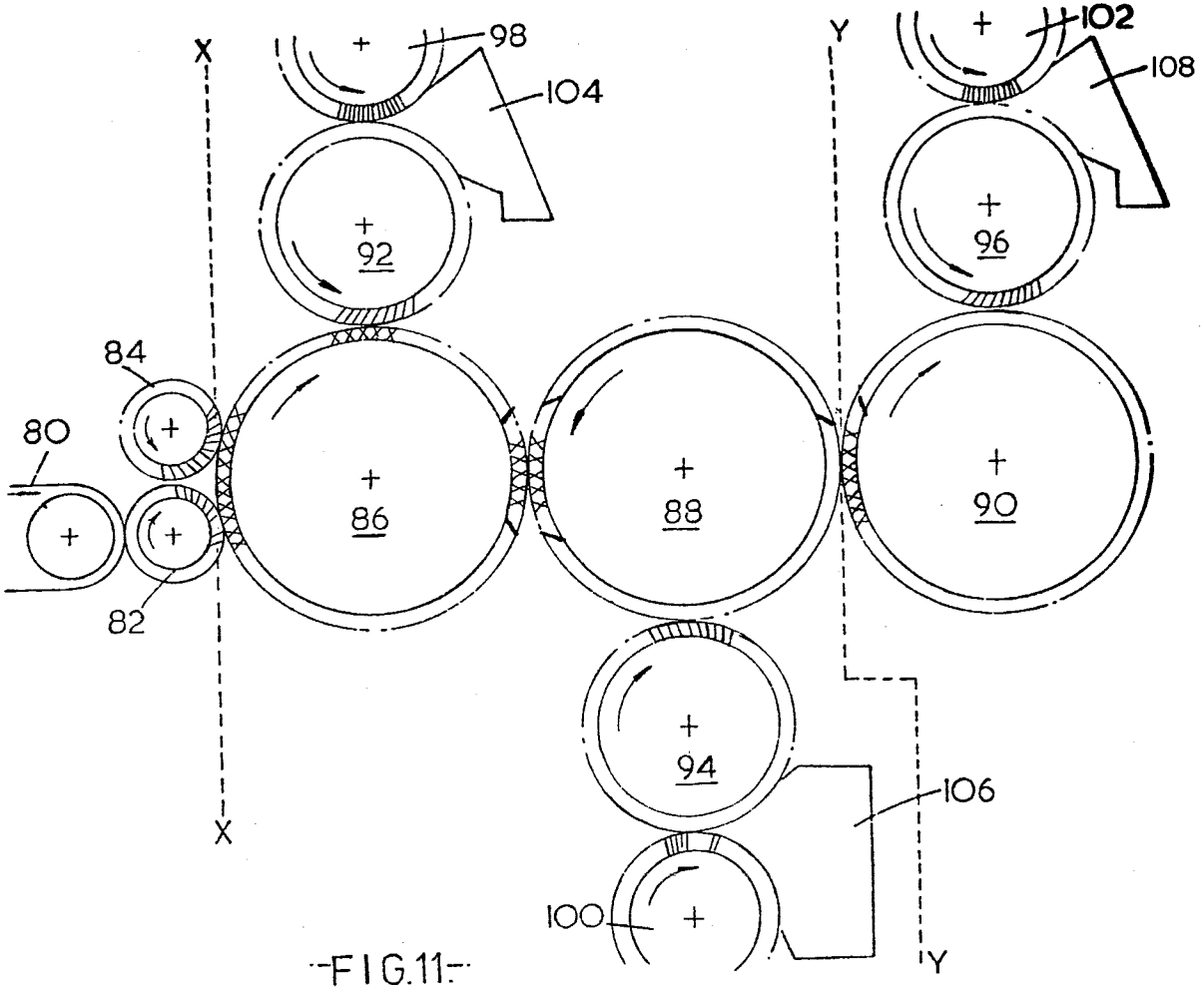
Figure 12:
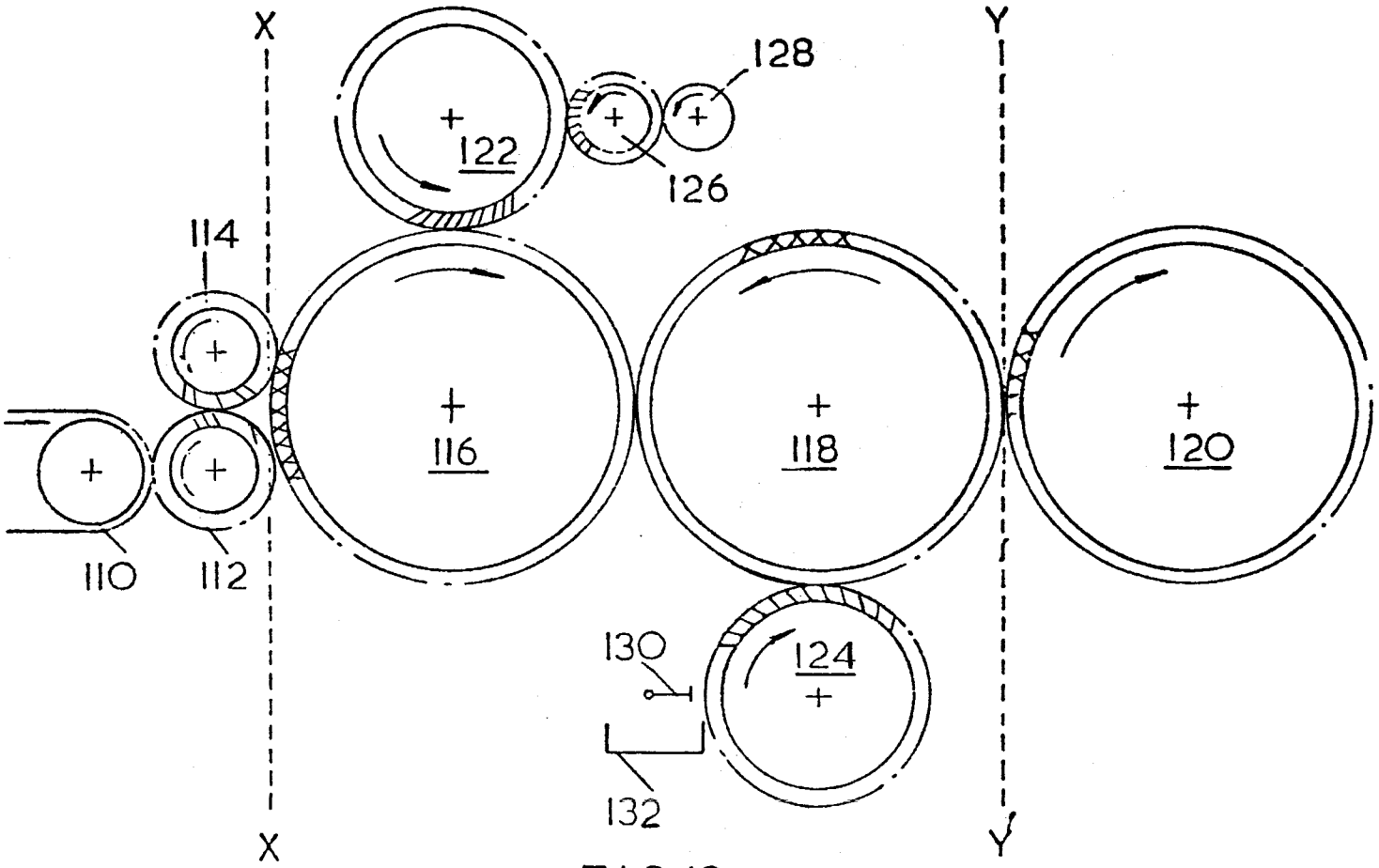
Figure 16:
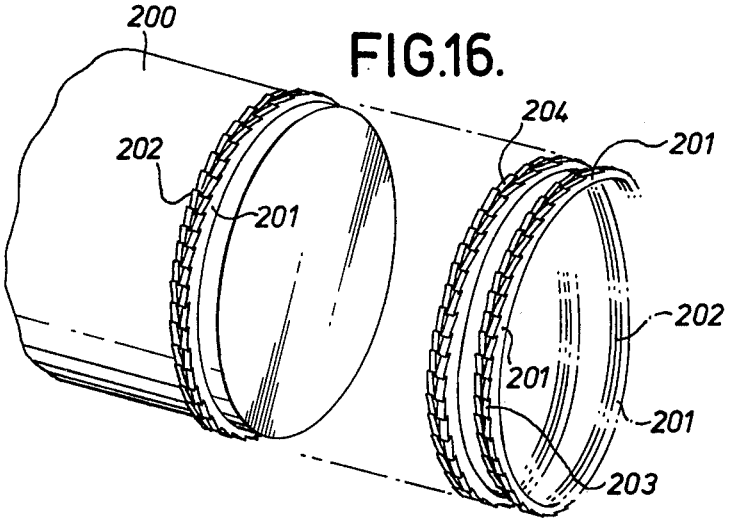
Figure 17:
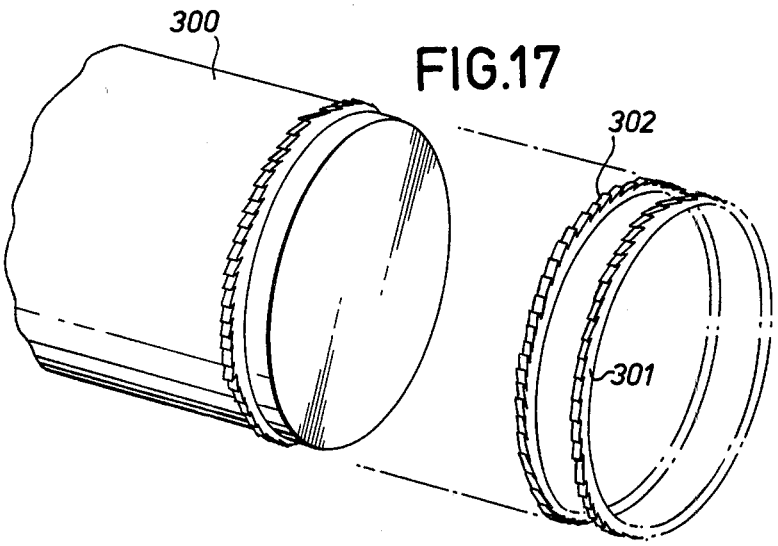

FIG. 8 is a side view of metallic wire card clothing for use with a burr beater, FIG. 9 is a section on the line "A—A" in FIG. 8, FIG. 10 is a diagram showing the zone of co-operation between the two card clothed rollers, FIG. 11 is a diagram showing a train of carding rollers in a practical embodiment of the invention, FIG. 12 is a diagram of another arrangement which can be used to separate fibres of different lengths, FIG. 13 is a diagram of another arrangement, in which there can be appreciable drafting of the fibres, FIG. 14 is a diagram of an arrangement of card clothed rollers, with provision for de-burring, FIG. 15 illustrates in diagrammatic form a still further possible carding roller arrangement, FIG. 16 is a perspective view showing one method of covering the surface of a roller with card clothing, and FIG. 17 is a perspective view similar to FIG. 16, but showing an alternative method of covering the surface of a roller with card clothing.

In FIG. 1 there is shown a flexible foundation 10, which may be of conventional construction formed of leather or layers of woven material impegnated with rubber solution. As shown, the foundation has to be capable of bending, so that if can be fitted around a roller (not shown) of a carding or opening machine. Two kinds of card clothing teeth 12 and 14 are fitted into the foundation. (In FIG. 1, the teeth 12 have been shown in full lines and the teeth 14 in dotted lines for clarity). The teeth themselves are of conventional construction and are formed in pairs in the manner of staples. Each "staple" is driven through the foundation 10 from the rear or underside, so that its pointed limbs project above the top surface 16 of the foundation leaving the "bridge" of the staple to form a crown 18 on the underside of the foundation.

It will be observed that the teeth 12 are inclined forwardly (assuming the clothing is to move to the right as seen in FIG. 1 when in use) and the teeth 14 are inclined rearwardly.

Although straight wires are illustrated in FIG. 1, it is to be understood that the wires could be kneed so long as the effective portions of one kind of wires are inclined forwardly and those of the other kind rearwardly.

FIG. 2 shows a piece of conventional metallic wire type card clothing 20 formed with a saw blade type teeth 22, only one of which is illustrated. The leading edge 24 of the teeth is the effective edge for carding or opening purposes, and the bottom surface 26 of the space between successive teeth forms the surface of the foundation when the wire is wound around a support roller — the teeth projecting above, and having their effective edges inclined relatively to this surface.

Between successive convolutions of the wire 20 on the roller, there are convolutions 28 of another wire coiled so that its teeth face in the opposite direction. Hence, supposing that the card clothing is to move to the right, then the leading edges on the wire 20 are inclined forwardly, but the leading edges on the other wire are inclined rearwardly relatively to the surface 26.

FIG. 16 shows how this covering of the cylindrical surface of a roller 200 may be carried out in practice. The roller 200 has a plain surface and two sets of metallic type card clothing 201 and 202 are employed to cover this surface. Each set of card clothing is in itself conventional, in that it comprises a long length of wire formed with teeth along its outer edge. The wire 201 has teeth 203 facing in a forward direction, having regard to the direction of rotation of the roller 200 in use, and may be compared to the wire 20 with its teeth 22 shown in FIG. 2. The wire 202 on the other hand has its teeth 204 facing in the opposite direction to the teeth 203 on the wire 201 and this wire 202 may be compared to the wire 28 shown in FIG. 2. The two wires 201 and 202 are placed side-by-side and coiled on to the roller 206 in the conventional manner, except that the width of each convolution is equal to the combined width of the two wires 201 and 202. In this way the entire cylindrical surface of the roller is covered with card clothing, but the teeth 203 and 204 on adjacent convolutions from one end of the roller to the other point in opposite directions.

FIG. 3 illustrates the same principle as that shown in FIG. 2, but using pins 30 and 32, similar to gramaphone needles, inserted through holes in the peripheral wall 34 of a roller, as in a porcupine. The pins are inserted so that all the pins 30 in a single row around the periphery of the roller point in one direction, but the pins 32 in the next adjacent row point in the opposite direction. Alternatively, successive pins in any circumferential row could be inclined forwardly or rearwardly either alternately or in any other grouping.

FIGS. 4, 5 and 6 show possible special tooth forms used on metallic wire, producing effective edges pointing in opposite directions.

FIG. 7 illustrates a special form of metallic wire, in which there are teeth pointing in opposite directions, and in which the teeth 40 pointing in one direction are of greater height than the teeth 42 pointing in the other direction. It will be appreciated that such an arrangement may be necessary in order to give special carding effects.

The angles of the effective working faces of the various teeth or wires relatively to the surface of the foundation are preferably within the range of 30° to 90°. It will be appreciated however that the angles of inclination are selected according to the function of the particular roller or flat on which the card clothing is to be used.

Referring now to FIGS. 8 and 9, there is illustrated a special form of metallic wire card clothing, intended to be used with a burr-beater roller, and it will be observed, that there is one tooth 50 of generally dovetial shape configuration, having a leading edge 52 pointing forwardly, and a trailing edge 54 pointing rearwardly. In addition, there is a second tooth 56 having leading and trailing edges 58 and 60, which are perpendicular to the tangent at the roller surface. This second tooth provides the surface against which the beater bars operate. Alternatively, wire as shown in FIG. 4, but with longer peripheral surfaces between the ends of the teeth would also be suitable for use with a burr beater.

With any of the metallic wire type of card clothing just described, instead of forming the wire in long lengths and winding it helically about a roller as is conventional practice, and as is illustrated in FIG. 16 the wire may be formed into endless rings of such an internal diameter that they can be threaded on to the roller. This method of covering the roller with card clothing is illustrated in FIG. 17, where 300 is a plain surfaced cylindrical roller, and wire rings 301 and 302 are shown ready to be threaded on to the roller. Each of the rings is formed by bending a length of ordinary card clothing wire into a circle and welding the ends together. The rings 301 and 302 formed in this way are identical, but they are arranged so that the teeth on the ring 301 point in the forward direction, having regard to the direction of rotation of the roller 300, but the teeth on the ring 302 point in the opposite direction. The rings are threaded on to the roller — only one is shown in position in the drawing — one after the other and always maintaining the alternating sequence of a ring 302 followed by a ring 301, until the entire surface of the roller is covered with abutting rings.

As an alternative to the above described method of forming the card clothed rings, toothed flat rings can be stamped from metal blanks and threaded on to the roller alternately with narrower plain (i.e. untoothed) spacer rings. Thus the rings of the teeth are fitted rather like the laminations of an electric motor core, and they have to be locked on the roller when they are all in position to prevent axial displacement of the rings.

A basic opening action performed with card clothing in accordance with the invention will now be described with reference to FIG. 10, wherein there are shown parts of two co-operating rollers 70 and 72, the roller 70 being clothed with conventional card clothing, having its teeth inclined in one direction — rearwardly relatively to the indicated direction of rotation — and the roller 72 having the special arrangement of the invention with some teeth inclined forwardly and other inclined rearwardly. In FIG. 10 teeth similar to those shown in FIG. 2 are illustrated on the roller 72, but it is to be understood that any of the types of card clothing previously described could be employed.

In the specification of British Pat. No. 1,075,444, there is described a method of carding, wherein there are two card clothed roller such as the rollers 70 and 72 but both clothed with conventional card clothing, one, the slower moving roller, having its teeth pointing rearwardly, and the other, the faster moving roller, having its teeth pointing forwardly. Thus, there is a point-to-point action of the teeth, and by an appropriate selection of the relative surface speeds of the two rollers (measured over the points of the teeth) it is possible to provide an opening action in the zone of co-operation between the two rollers, whereby substantially all the fibres are carried forwardly on the faster moving roller, but at least some of the fibres are retarded in the zone of co-operation by the slower moving roller, and this performs a special opening action. This action can be repeated between the faster moving roller, and further slower moving rollers. In order to remove the fibres from the faster moving roller it is necessary to use the point to back-of-point action of a further (stripper) roller, having forwardly facing teeth, and a higher surface speed than the fast roller.

If one considers the rollers 70 and 72 and assumes that the roller 72 is the faster moving roller, than one could obtain the opening action described in British Pat. Specification No. 1,075,444 between the two rollers, but if the roller 72 had only forwardly inclined teeth, then the fibres could only be removed from the roller 72, by a stripping roller (not shown), having forwardly pointing teeth, which operate with a point to back-of-point action relatively to the forwardly pointing teeth of the roller 72, by virtue of a higher surface speed of the stripping roller.

However, if the roller 72, is clothed with the special card clothing of the kind illustrated in any of FIGS. 1 to 9, with some teeth pointing forwardly, and some teeth pointing rearwardly, the forwardly pointing teeth will produce the opening action relatively to the slower moving roller 70, and at the zone of co-operation with that roller, the rearwardly pointing teeth will be inactive. If a third roller (not shown) provided with forwardly pointing teeth and having a greater surface speed than the roller 72, co-operates with the roller 72, at some position around its periphery other than at which it co-operates with the roller 70, the same (point-to-point) opening action, as that between the rollers 72 and 70, will take place between the rearwardly pointing teeth on the roller 72 and the forwardly pointing teeth on the additional roller. It thus becomes possible to produce a train of rollers of any number greater than two in which material is opened and drafted continuously, the opening and drafting action always taking place between teeth having a point-to-point action.

It will be appreciated that this greatly reduces the size of the carding machine required to perform a particular opening action, because with rollers clothed with card clothing of conventional type, in which all the teeth on one roller are inclined in the same direction, it was necessary to follow each opening action by a stripping action, whereas by using the card clothing provided by the invention, at every zone of co-operation between two rollers, there is an opening and drafting action.

It can be said, that at a first position, one kind of teeth on the second roller 72, are operative and the other kind inoperative, whereas this is reversed, in a second zone of co-operation, with a further roller.

As has been disclosed in said British Pat. Specification, it is desirable that the surface speed of the slower moving roller (the roller 70 in the arrangement shown in FIG. 10) shall not be less than 30% that of the faster moving roller. This is in contradistinction to conventional swift-and-worker roller or cylinder and moving flat arrangements wherein the speed differential between the two rollers (or the roller and flats) is at least 50:1 and sometimes 100:1. It is this relating low speed ratio which produces the gentle opening action without tearing the fibres which is a preferred feature of the instant invention.

Of course, there has to be some speed differential between the two rollers, or no opening action would take place. It can be said however that the surface speed of the slower moving roller should lie within the range of 30% to 100% that of the faster moving roller.

The arrangement shown in FIG. 11 is a practical carding or opening arrangement. It should be explained that any of the arrangements shown in FIGS. 11 to 15 can be employed in a carding or scribbling machine, or can be used as a means of opening fibres in situations where a carding machine would not normally be used. For example, it is possible to use the opening and drafting action of a train of rollers in place of the fallers in a gill box.

Material is fed to the train of card clothed rollers on a feed conveyor 80 and it is removed from the conveyor by a first feed roller 82. The latter co-operates with a faster running second feed roller 84 and the teeth on the two feed rollers and their relative surface speeds are so arranged that there is the opening action between them which is described in the Specification of British Pat. No. 1,075,444. This means that the fibres are carried round on the feed roller 84.

From the feed roller 84, the material passes on to a first roller 86, which forms the first of a train of opening and drafting rollers 86, 88 and 90 arranged in a straight row. Each of the rollers 86, 88 and 90 is equipped with the special card clothing with two kinds of teeth one kind inclined forwardly and the other kind inclined rearwardly. In FIG. 11 the teeth on the opening rollers are only illustrated diagrammatically.

Above the first roller 86, there is a co-operating retarding roller 92 which has a slower surface speed than the roller 86 and ordinary card clothing with rearwardly inclined teeth. Hence, as the material on the roller 86 travels through the zone of co-operation with the roller 92, there is an action between the teeth on the retarding roller 92 and the forwardly inclined teeth on the roller 86 which is similar to that described in British Pat. No. 1,075,444 — that is to say, there is a gentle opening action. During this co-operation between the rollers 86 and 92, the rearwardly inclined teeth on the roller 86 are inactive.

Now the second roller 88 travels at a greater surface speed than the first roller 86, (the speed of the first roller being not less than 30% that of the second roller) so that in the zone of co-operation between these two rollers, there is point-to-point action between the forwardly inclined teeth on the second roller 88 and the rearwardly inclined teeth on the first roller 86 (and the forwardly inclined teeth on the roller 86 and the rearwardly inclined teeth on the roller 88 are inactive) so that the opening action is performed between the two rollers and the fibres are transferred to the roller 88. The latter has a co-operating retarding roller 94, which is similar to and has the same kind of action as the roller 92.

The third roller 90 rotates with a faster surface speed than the second roller 88 (the speed of the second roller being not less than 30% that of the third roller), and in the zone of co-operation between the rollers 88 and 90 there is the opening action and the fibres travel on to the roller 90, which also has a co-operating retarding roller 96.

Thus in the short space occupied by the train of rollers shown in FIG. 11, there are no less than seven opening actions, and there is drafting of the kind described with reference to FIG. 10, between the rollers 86 and 88 and between the rollers 88 and 90. The rollers covered with the special card clothing take part in opening actions at every zone of co-operation with other rollers rather than at only some such zones as with conventional card clothing.

It is to be understood that the top feed roller 84 could be provided with the special card clothing to provide for an opening as well as a stripping action between that roller and the first roller 86. Each of the retarding rollers 92, 94 and 96 has an associated brush 98, 100 and 102 respectively, these brushes rotating at high speed and operating in known manner to remove burrs and other waste matter from the retarding rollers. Burr trays and scrapers 104, 106 and 108 are associated with the respective brushes 98, 100 and 102 for the purpose of collecting the burrs and waste.

The length, frequency (or density) and disposition of the teeth on the rollers — especially on the rollers 86, 88 and 90 — will be chosen according to the thickness of the web of fibrous material which is to be opened, and the state of entanglement or openess of the fibres. Generally speaking, the length of the teeth will decrease and the density of the teeth will increase from the feed rollers onwards.

The drafting of the web which takes place between the opening rollers preferably increases progressively from the feed rollers onwards. Thus, in the three-roller train illustrated, the surface speeds of the rollers may have the ratios 7/10, 6/10 and 5/10 to produce a progressive increase in drafting, but the ratio must not be so great as to prevent a following roller stripping an earlier roller.

It will be understood that the arrangement can be extended as desired, the parts between the lines X—X and Y—Y constituting a "repeat" of the opening arrangement.

The carding arrangement shown in FIG. 12 is similar to that of FIG. 11, but instead of being used simply for opening the fibres, is also useful for dividing the material into batches of long and short fibres, as is required for example in the worsted process. Again, there is a feed conveyor 110, a pair of feed rollers 112 and 114, and a train of opening rollers 116, 118 and 120. The opening rollers are provided with the special card clothing and there are co-operating retarding rollers 122, 124 etc. As with the previously described arrangement, the parts between the lines X—X and Y—Y constitute a "repeat" which can be duplicated as many times as required.

A small card clothed stripper roller 126 co-operates with the retarding roller 122, and is itself stripped by a bright roller 128. The latter is a smooth surfaced metal roller. A fly comb 130 acts on the retarding roller 124 and material removed by this comb passes on a side-feed arrangement 132 to a subsequent process.

The special opening action, in which all the fibres are first enmeshed in the teeth of the retarding roller 122 and then drawn out again by the forwardly inclined teeth of the roller 116 as described in the Specification of British Pat. No. 1,075,444 depends primarily on the relationship between the diameter of the two rollers and their relative surface speeds (measured over the tip of the teeth) for any given fibre length. If the speed of the roller 122 is reduced below a certain critical speed, then the roller 116 will not be able to strip of all the shorter fibres — though of course, a proportion of the shorter fibres will be so entangled with the longer fibres that they will be carried forward on the roller 116. Hence some of the shorter fibres are retained on the roller 122, to be removed by the stripper roller 126 and bright roller 128. A further batch of short fibres are removed by the fly comb 130 from the retarding roll 124. The stripper roller 126 and the fly comb 130 are shown by way of examples since other methods of removing the short fibres (such as suction) could equally be employed. The longer fibres on the train of the opening rollers are removed by the doffer (not shown) at the output end of the machine. As the fibrous material travels on this train, the shorter fibres are progressively removed, and they can be divided into batches of predominently intermediate fibre-lengths by a suitable control of the speeds of the returning rollers.

FIG. 13 shows a very simple roller train which is intended to be used for the drafting of fibrous silver or rovings. At the input end of the machine, there is a pair of feed rollers 140 and 142. These can be plain rollers, fluted rollers or pinned rollers, and their purpose is to feed the material on to the first of a train of drafting rollers 144, 146, 148, 150 . . . each of which is clothed with the special card clothing having teeth inclined in opposite directions.

In order to obtain a uniform web or sliver as a result of a drafting process, it is essential to control the fibres as fully as possible. This has been attempted in many ways, for example by the use of pinned faller bars as in a gill box, or by use of light tumbler rollers, drafting aprons and like control arrangements. With the arrangement shown in FIG. 13 the fibres remain under close control, particularly if the size of the rollers 144, 146 . . . . is such that a long fibre is being acted on by the co-operating teeth of these rollers is more than one position at a time. In other words, it is possible to have a fibre which is on all three rollers 144, 146 and 148 and is being combed at the zone of co-operation between the roller 144 and 146 and at the zone of co-operation between the roller 146 and the roller 148. In this way a close degree of control is possible over the drafting process. As with the arrangement of FIG. 11, there is preferably an increasing draft from the feed rollers onwards through the machine.

The degree of drafting possible between each co-operating pair of rollers will depend on the diameters of the rollers and the fibre lengths. The diameter of the rollers will also be influenced by the fibres length of the material being drafted and the possibility of fibre breakage if a fibre is too firmly held by two rollers having large differences of surface speeds. The drafting action will also be influenced by the density of the teeth on the rollers and the length and working angle of the teeth.

Although the arrangement shown in FIG. 11 is adapted to remove a considerable proportion of burrs, it is not so effective in this direction as apparatus designed specifically for this function, such as the well known MOREL roller arrangement. Therefore, if burr removal is important, an arrangement such as that shown in FIG. 14 can be used.

Two of the opening rollers 160 and 162 are covered with the special metallic wire card clothing shown in FIGS. 8 and 9, so that the burrs will stand proud on the smooth surfaces of the wire. It should also be explained that the rear parts of the teeth between the edges 58 and 60 extend across the full width of the roller without gaps as between the front parts of the teeth. A beater roller 164 is associated with each roler 160 and 162 and operates in the conventional manner to remove the burrs. Burr trays and scrapers 166 are also provided.

FIG. 15 illustrates a space-saving arrangement of a train of opening rollers 170, 172 and 174 which can be applied to any of the systems shown in FIGS. 11 to 14. The axes of the rollers are staggered instead of being in one plane, and this enables the train of rollers to take up less length than is the case with the single plane arrangements shown in FIGS. 11 to 14.

The arrangement shown in FIG. 15 provides two possible routes for the material depending upon the directions of rotation of the rollers 170, 172 and 174. If the directions of rotation are as shown in the drawings, then the material will follow a "long" route (i.e. under the roller 170, over the roller 172 and under the rollers 174). The smaller rollers shown co-operating with the rollers 170, 172 and 174 will, if provided, carry out additional opening of the fibres.

If the directions of rotation of the rollers 170, 172 and 174 are reversed, then the material will follows a "short" route (i.e. over the roller 170, under the roller 172 and over the roller 174). In this case, the small rollers would be redundant. The "short" route is preferably for simple drafting, as when replacing the fallers of a gill box.

In FIGS. 10 to 15 all the rollers are illustrated with minute clearances between the teeth on co-operating rollers. This arrangement is essential where the teeth follow a helical path along a roller, but if the teeth are formed on rings, then it is possible to set the teeth of one roller into the teeth of the co-operating roller, since the teeth of one roller can pass in the annular spaces between the teeth on the other roller.

It is, of course, necessary to provide for removal of the fibres from the last roller of the train which is covered with the special card clothing. This can be achieved by known means, such as:

(a) A doffer, the action being between the forwardly inclined teeth of the roller and the backwardly inclined teeth of the doffer as partially illustrated at 176, FIG. 15.

(b) An additional roller covered with forwardly inclined teeth stripping the last opening roller, a fancy, lifting the web on this additional roller and a doffer.

(c) An additional roller with forwardly inclined teeth, and a brush removing the material from the additional roller and depositing it on to a Morel roller or a doffer (d) A doffer stripped by a suction conveyor arrangement.

(e) A suction device removing material from the last roller with the special card clothing and feeding it to an open-end spinning device or to a web treating machine for non-woven fabrics.

It is to be understood that any of the arrangements shown, can be used to open rags as well as for opening and drafting fibres. It is to be understood therefore that the expression "fibre opening machine" in the appended claims is used in a very broad sense so as to include rag opening.

I claim:

1. In a fibre opening machine, a roller train comprising first, second and third card-clothed rollers and operatively connected drive means therefor, said first card clothed roller rotating in a first direction and having at least some of its teeth pointing in a direction opposite to said first direction and at least some of its teeth pointing in said first direction; said second card clothed roller adjacent to and co-operating with the said first card clothed roller, but rotating in the opposite direction to said first card clothed roller, the surface speed of said first roller being not less than 30% that of said second roller; and said third card clothed roller adjacent to and co-operating with said second roller, said third roller having at least some of its teeth pointing in the direction of rotation of said third roller and at least some of its teeth pointing in a direction opposite to said direction of rotation of said third roller, and said third card clothed roller rotating in said first direction; the surface speed of said second roller being not less than 30% that of said third roller, said second card clothed roller having a first set of teeth pointing in the direction of rotation of said second roller so as to have point-to-point action with said teeth on said first card clothed roller whereby fibres on the teeth of said first card clothed roller are subjected to a gentle opening action and are transferred to the second card clothed roller on which they form a thinner web than on said first card clothed roller and a second set of teeth pointing in the opposite direction to the direction of rotation of said second roller so as to have point-to-point action with said teeth on said third card clothed roller whereby fibres on the teeth of said second card clothed roller are subjected to a gentle opening action and are transferred to the third card clothed roller on which they form a thinner web than on said second card clothed roller; and means for doffing fibres from said third card clothed roller.

2. In a fibre opening machine according to claim 1 all of said first, second and third card clothed rollers having substantially the same diameter.

3. In a fibre opening machine, a roller train according to claim 1, wherein said second card clothed roller is clothed with helically wound first and second metallic wires, the convolutions of said first wire lying between the convolutions of said second wire, and the teeth on said first wire pointing in the opposite direction to those of said second wire.

4. In a fibre opening machine, a roller train according to claim 1, wherein said second card clothed roller is covered with metallic wire card clothing said wire having special teeth each of which has oppositely directed effective edges to provide teeth of said first and second sets.

5. In a fibre opening machine, a roller train according to claim 1, wherein said second card clothed roller is covered with rings of metallic wires, said rings being threaded on to said second roller and then locked against axial movement thereon.

6. In a fibre opening machine, a roller train according to claim 1, wherein the axes of said first, second and third rollers are arranged in a staggered formation so that the overall length of the train is less than the sum of the three outside diameters of said rollers.

7. In a fibre opening machine, a roller train according to claim 1, wherein said first and second sets of teeth on said second card clothed roller are of approximately the same height, and said first and second sets of teeth are intermingled over substantially the entire surface of the clothing.

* * * * *